US009199259B2

(12) United States Patent
Corbellini et al.

(10) Patent No.: US 9,199,259 B2
(45) Date of Patent: Dec. 1, 2015

(54) ACTUATOR WITH SELF-CONTAINED LIGHT SOURCE

(71) Applicant: ELC Management LLC, Melville, NY (US)

(72) Inventors: Francis Corbellini, Thiais (FR); Herve F. Bouix, New York, NY (US)

(73) Assignee: ELC MANAGEMENT LLC, Melville, NY (US)

( * ) Notice: Subject to any disclaimer, the term of this patent is extended or adjusted under 35 U.S.C. 154(b) by 137 days.

(21) Appl. No.: 14/221,368

(22) Filed: Mar. 21, 2014

(65) Prior Publication Data

US 2015/0266042 A1 Sep. 24, 2015

(51) Int. Cl.

| | |
|---|---|
| ***B05B 11/00*** | (2006.01) |
| ***F21V 33/00*** | (2006.01) |
| *F21Y 101/02* | (2006.01) |

(52) U.S. Cl.

CPC ..... *B05B 11/3052* (2013.01); *B05B 11/0005* (2013.01); *F21V 33/0004* (2013.01); *F21V 33/0064* (2013.01); *F21Y 2101/02* (2013.01)

(58) Field of Classification Search

CPC ..... F21V 33/0004; F21V 33/0064; B05B 11/0005

USPC ..... 222/113, 321.1–321.9, 383.1, 383.3, 222/402.1

See application file for complete search history.

(56) References Cited

U.S. PATENT DOCUMENTS

| | | | | |
|---|---|---|---|---|
| 5,683,168 | A | 11/1997 | Teig et al. | |
| 7,690,532 | B2 * | 4/2010 | Walther | A47K 5/1202 222/113 |
| 8,210,395 | B1 | 7/2012 | Morris | |
| 8,499,974 | B2 * | 8/2013 | Bennett | B65D 83/205 222/113 |
| 8,875,946 | B2 * | 11/2014 | Muller | B05B 11/3001 222/113 |
| 2007/0291488 | A1 * | 12/2007 | Heathcock | H05B 39/00 362/276 |
| 2009/0145925 | A1 * | 6/2009 | Wegelin | B05B 11/3042 222/113 |
| 2009/0166378 | A1 * | 7/2009 | Stilley | B05B 1/00 222/39 |
| 2013/0032610 | A1 * | 2/2013 | Muller | B05B 11/3001 222/113 |
| 2013/0082070 | A1 * | 4/2013 | Feriani | F21V 33/0004 222/113 |
| 2013/0122817 | A1 * | 5/2013 | Pivaudran | A45D 34/04 455/41.2 |
| 2014/0084024 | A1 * | 3/2014 | Benda | A47L 15/006 222/113 |

* cited by examiner

*Primary Examiner* — Donnell Long
(74) *Attorney, Agent, or Firm* — Peter Giancana NA

(57) ABSTRACT

An actuator with a self-contained light source may be designed to fit on any conventional pump dispenser or valve of a pre-pressurized dispenser in a completely conventional manner. As a result, the feature of light may easily be added to a conventional pump or aerosol valve dispenser, without having to customize the pump or valve. When a user depresses the actuator to dispense product, an electric lighting circuit within the actuator is completed. The light may be effective to activate a product as it is being dispensed.

15 Claims, 10 Drawing Sheets

ACTUATOR WITH SELF-CONTAINED LIGHT SOURCE

FIELD OF THE INVENTION

The present invention pertains to actuators for hand-held pump and pre-pressurized packages, such as aerosol packages and reservoir-under-pressure type systems.

BACKGROUND

Pump dispensers are common in the personal care and cosmetics markets. A basic handheld pump dispenser comprises an accumulator, a spring, a stem and an actuator, and typically dispenses between 50 and 500 μl of product (although some may dispense more or less) with each full stroke of the pump. A means is provided for securing the pump to a reservoir of product. The operation of such devices is well known. When the actuator is depressed, product passes from the accumulator, into and through the stem. Product continues into and through the actuator, and emerges from a nozzle of the actuator. When the actuator is released, product is drawn from the reservoir into the accumulator, to be ready for the next use. Actuators are also common on pre-pressurized packages, such as aerosol valve dispensers, and reservoir-under-pressure type systems, which are also operated by depressing an actuator to dispense a product.

Treating products with light is known. Products are treated with light for various reasons. For example, it is known to treat water with light to kill germs. It is also known to use light to cure dental adhesives. Light has been used to initiate chemical reactions that may not occur in the absence of light. Light has been used a reagent or catalyst in many chemical and biological reactions.

Combining pump dispensers with light sources is known. For example, U.S. Pat. No. 8,210,395 discloses a spray dispenser and light emitting assembly. The assembly includes a pump and an actuator. When the actuator is depressed, product is dispensed and an electric lighting circuit is closed. The lighting circuit is housed partially in the pump, and partially in the actuator. As the actuator slides down, an electrical contact in the actuator registers with an electrical contact in the pump housing, to complete the lighting circuit. This design requires a custom actuator and a custom pump. For example, the actuator of '395 cannot simply be placed on a conventional pump and achieve the same results. This is unlike the actuator of the present invention which can be placed on any conventional pump or aerosol dispenser to add the feature of one or more light sources.

OBJECTIVES

A main objective of the present invention is to provide an actuator with a self-contained light source, wherein the actuator can easily be fitted to any conventional pump or pre-pressurized valve dispenser.

Another object of the invention is to provide an actuator that irradiates a product as it passes through the actuator, in the normal operation of a pump.

SUMMARY

Embodiments of the present invention include an actuator with a self-contained light source. All of the components necessary to generate light are housed in the actuator, and the actuator may be designed to fit on the stem of any conventional pump dispenser or in the valve of a pre-pressurized dispenser, in a completely conventional manner. As a result, the feature of light may easily be added to a conventional pump or pre-pressurized dispenser, without having to customize the pump or valve. When a user depresses the actuator to dispense product, an electric lighting circuit within the actuator is completed. The light may be effective to activate a product as it is being dispensed.

DESCRIPTIONS OF THE FIGURES

FIG. 1 is a depiction of one embodiment of an actuator according to the invention, seated on a container with pump dispenser.

FIG. 2*a* is an exploded view of one embodiment of an actuator according to the present invention.

FIG. 2*b* is a cross-sectional view of the actuator of FIG. 2*a*.

FIG. 3*a* is a cross-sectional view of one embodiment of a fully assemble actuator seated on a conventional pump dispenser. The actuator is shown in a non-actuated position.

FIG. 3*b* highlights the relationship between the nozzle (3) and the lens (4) when the actuator is depressed.

DETAILED DESCRIPTION

In the detailed description, actuators according to the invention will be described in relation to a lotion pump dispenser. However, the principles of the invention are applicable to other product dispensers such as liquid pump dispensers and pre-pressurized valve dispensers such as aerosols and reservoir-under-pressure type packages. Also, the dispensers contemplated herein are handheld. By "handheld" we mean a device that is intended to be held in one hand and raised in the air as a user dispenses product. Thus, "handheld" means more than just being able to grasp an object. For example, a "space heater" does not meet this definition of handheld. Throughout the specification "comprise" means that an element or group of elements is not necessarily limited to those elements specifically recited, and may or may not include additional elements.

Overview

Figure 1:
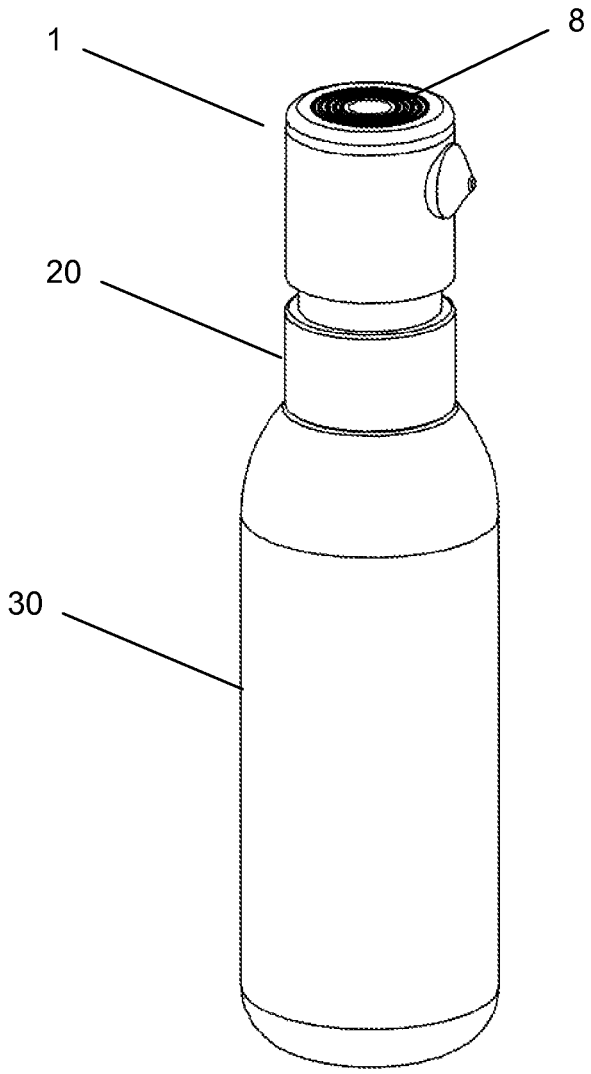
Figure 2A:
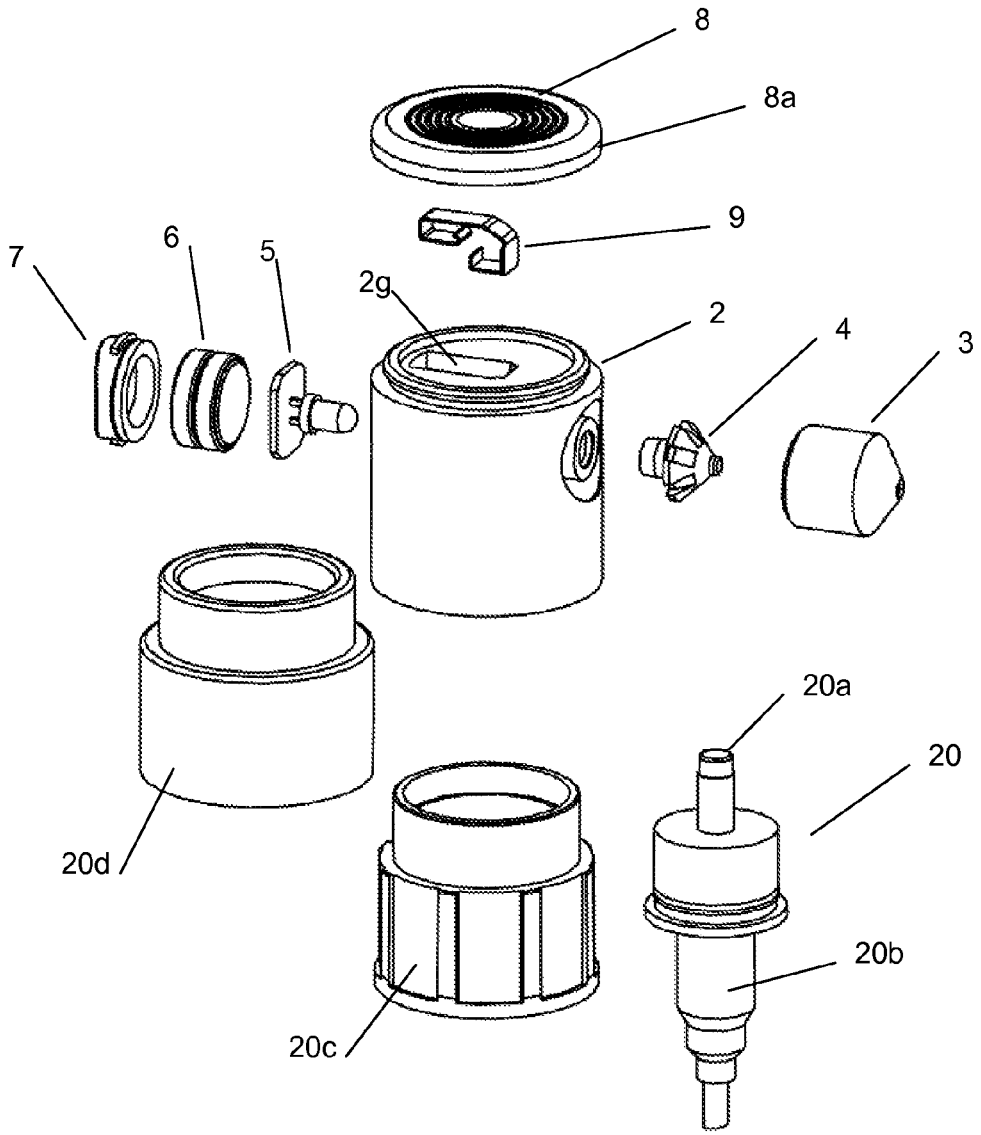

FIG. 1 is a depiction of one embodiment of a consumer package. The depiction includes an actuator (1) according to the invention, seated on a pump or pre-pressurized dispenser that is attached to a container/reservoir. As can be seen, from the outside, the actuator appears completely conventional. The actuator may easily be designed to fit on any conventional pump (20) or valve which attaches to and draws product from container/reservoir (30). Referring also to FIG. 2*a*, common means of attaching a pump to a container include a screw type closure (20*c*) as part of the pump, the closure having threads that cooperate with threads on the container. Alternatively, lotion pumps, spray pumps and valves of pre-pressurized systems are known to have ferrules that may be crimped onto a container. The closure or ferrule may be provided with an overshell (20*d*) for purely decorative purposes. How the pump or valve attach to a container does not affect the operation or usefulness of an actuator according to the present invention. Actuators according to the present invention interact with the stem or valve of the dispensing system in the usual manner of actuators.

Figure 2B:
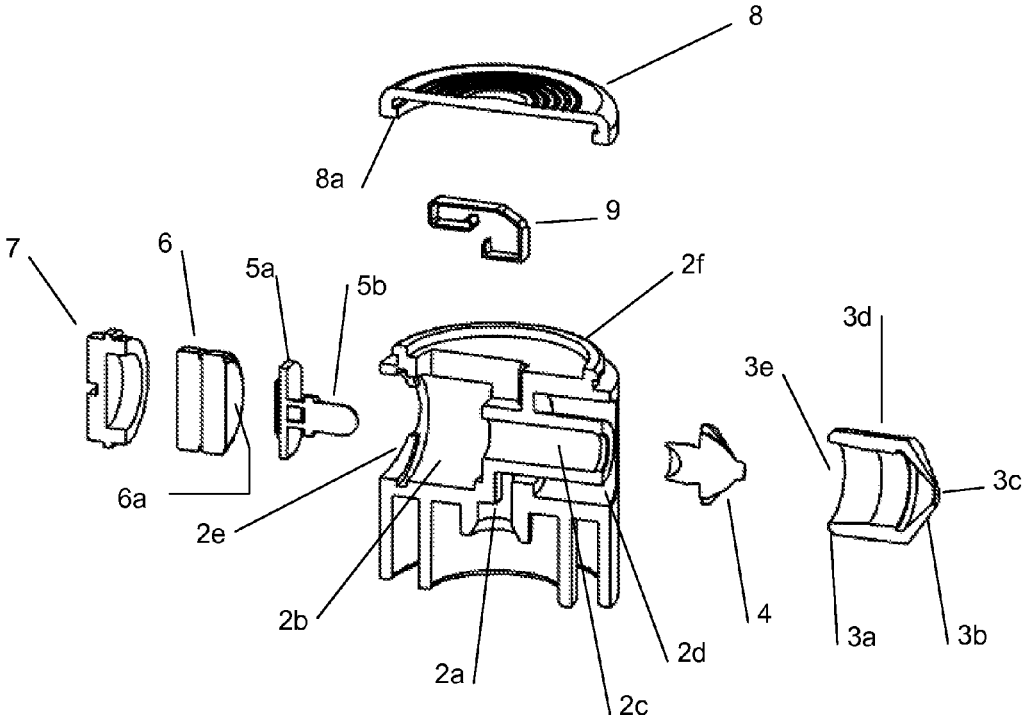

As shown in FIG. 2*a*, some embodiments of an actuator (1) of the present invention comprise a body (2), a nozzle (3), a lens (4), a light source assembly (5), a power source (6), a cap (7), an on/off switch (8) for the light source, and a flexible electrical conductor (9). Referring to FIG. 2*b*, the body (2) of the actuator houses and supports all the other parts of the actuator within the interior of the actuator, and makes a connection to the stem (20*a*) of the pump dispenser. The stem of the dispenser fits into a channel (2*a*) of the actuator, as is the case with conventional pump dispensers and actuators. An actuator of the present invention can easily be manufactured to fit on any pump stem. Alternatively, when an actuator according to the present invention is to be used with a pre-pressurized dispenser, the actuator will be equipped with a stem that fits into a channel in the valve of the dispenser, in the conventional manner.

When the actuator is assembled on a pump dispenser, a product passageway (10) is defined that leads from the stem of the pump to a product exit orifice (3*c*) of the nozzle. The exit orifice opens to the exterior of the actuator, and from the exit orifice, product is transferred to an application surface. Along a portion of this passageway, product is irradiated, and a means may be provided for opening and closing the passageway.

Unlike conventional actuators, the body (2) has a light source housing (comprised of back section 2*b*, and front section 2*c*). The back section (2*b*) of the light source housing is larger than the front section (2*c*). The power source (6) is located in the back section (2*b*). Adjacent to the power source, and in electrical contact with it, is the light source assembly (5). The light source (5*b*) of the light source assembly extends into the front section (2*c*) of the light source housing. Further toward the front of the housing is the lens (4). Surrounding the front section (2*c*) of the housing is a cylindrical space (2*d*) for receiving the nozzle (3). A push button (8) that turns the light source on and off sits atop the actuator. Just below the on/off button is a flexible electrical conductor (9). An optional opening (2*e*) at the back of the body allows access to the power source and light source assembly. The opening (2*e*) may be closed by cap (7).

The Nozzle and the Lens

Referring to FIGS. 2*b*-4, the nozzle (3) comprises a cylindrical wall (3*d*) that is opened at a proximal end (3*a*), while the distal end (3*b*) tapers down to orifice (3*c*). The opening (3*e*) at the proximal end (3*a*) of the nozzle is sufficiently large to receive into itself a portion of the lens (4). The cylindrical wall of the nozzle is retained in the cylindrical space (2*d*). One function of the nozzle is to receive product from the pump (20), and convey the product along the product passageway (10), out of the orifice, to the exterior of the actuator (1). Referring to FIG. 3*a*, a first portion of the product passageway (10) is defined by first passage (10*a*). First passage (10*a*) is defined, in part, by an inner surface (3*f*) of the nozzle, and an outer surface (2*h*) of the front section (2*c*) of the light source housing. Product that emerges from the stem (20*a*) of the pump must flow into first passage (10*a*).

The lens (4) sits in front of the light source (5*b*). Light from the light source must pass through the lens, and possibly be redirected (i.e. refracted), before reaching the product. A proximal portion (4*a*) of the lens is secured in the front section (2*c*) of the light source housing. Preferably, the fit between the lens and the front section of the housing is water tight, or substantially so, to prevent product from entering the light source housing, where it would interfere with operation of the actuator. A distal portion (4*b*) of the lens protrudes into the nozzle (3), creating second passage (10*b*) between the lens and the nozzle, that is continuous with first passage (10*a*). As a result, product passageway (10) comprises first passage (10*a*) and second passage (10*b*), which terminates with the exit orifice (3*c*).

Figure 3A:
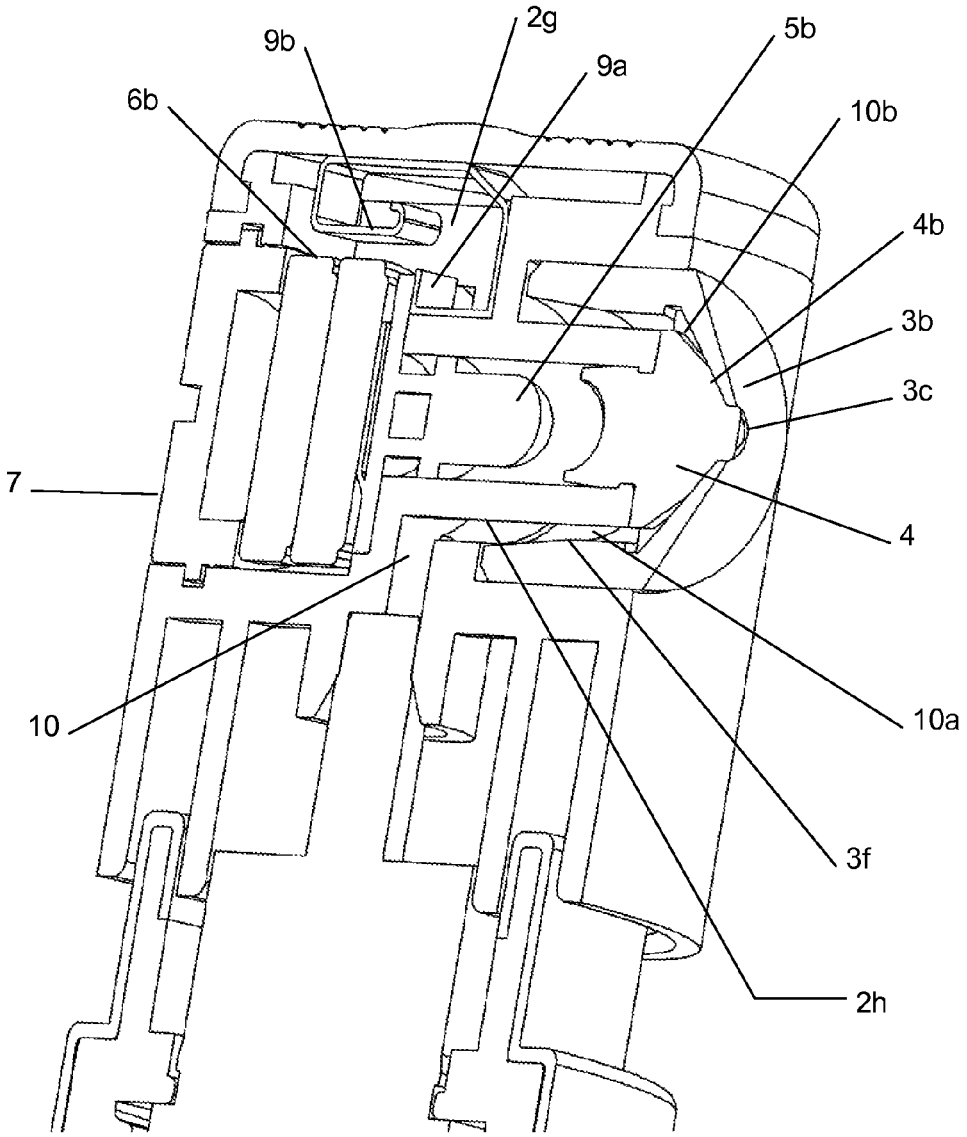
Figure 3B:
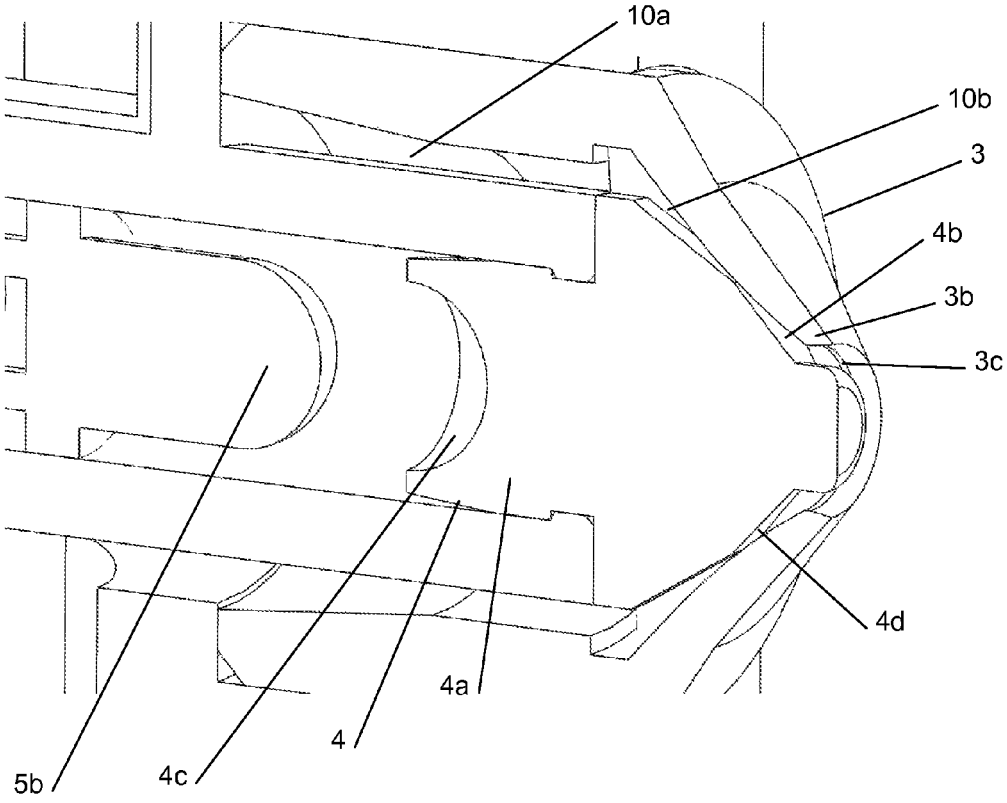
Figure 4:
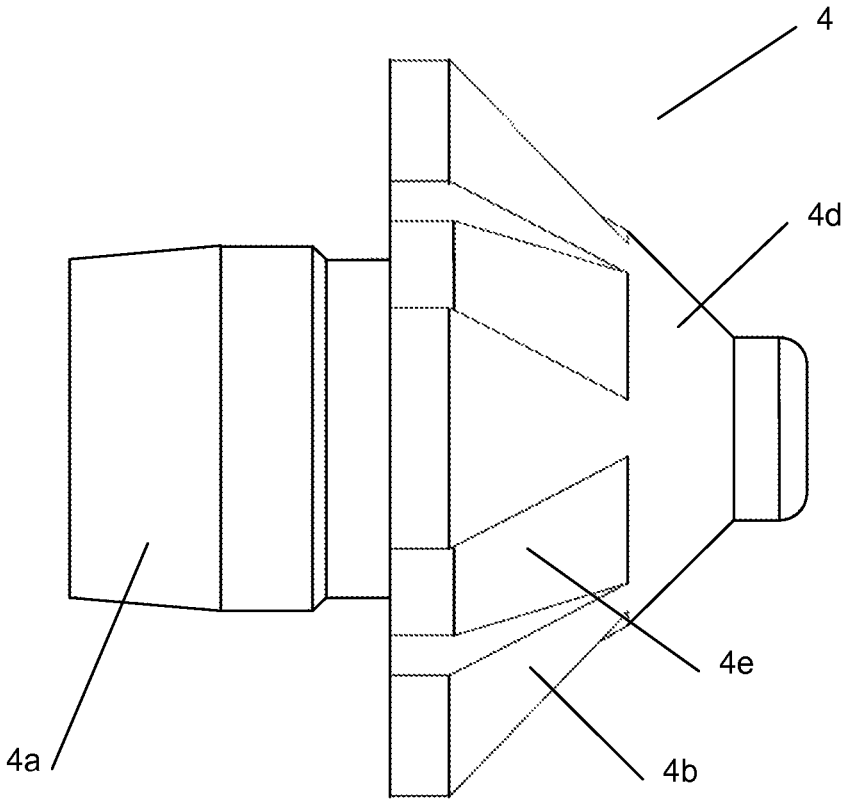
FIG. 4 is a perspective view of one embodiment of the lens (4).

Preferably, the proximal portion (4*a*) of the lens (4) comprises a concave back side (4*c*; see FIG. 3*b*), and the distal portion (4*b*) comprises a front side (4*d*; see FIG. 4) that approximates convex or conical. As such, light from the LED (5*b*) is refracted through the lens, and emerges radially from the convex front side of the lens, into the product in the second passage (10*b*). The distal portion of the lens (4) may also comprise one or more grooves (4*e*) that permit more product to fill the second passage (10*b*). Nevertheless, in preferred embodiments, the distal end (3*b*) of the nozzle (3) fits very closely over the distal portion (4*b*) of the lens (4), so that there is contact between the nozzle and the lens, effectively obstructing second passage (10*b*) when product is not flowing through the actuator. This is shown in FIG. 3*a*. This feature helps to protect product in the actuator from dry out and contamination. However, the distal end (3*b*) of the nozzle is sufficiently flexible (i.e. by being made thin) so that when the actuator is depressed, the distal end of the nozzle flexes slightly, to open up the second passage (10*b*) and allow product to flow to and out of the exit orifice (3*c*). This is shown in FIG. 3*b*. Thus, in preferred embodiments of the present invention, the nozzle and the lens cooperate to open and close the product passageway (10).

Because the distal portion (4*b*) of the lens (4) protrudes into the nozzle (3), product that flows through the second passage (10*b*) comes into contact with and flows right over the lens. As it flows over the lens, product is spread flat and relatively thin, perhaps no more than 2 mm thick, preferably no more than 1 mm thick, more preferably no more than 0.5 mm thick. The thinness of the product allows light to penetrate effectively, unlike some prior art devices, ensuring that all portions of the dispensed product have been sufficiently and evenly illuminated. In contrast, if the illuminated product were too thick, then all of the product may not be evenly illuminated, depending on how far into the product the light may penetrate. Thus, the present invention constitutes a significant improvement over prior art devices. The same mechanism that spreads the product thin for light to penetrate, is also used to open and close the product passageway (10) to reduce dry-out and contamination.

The Light Source Assembly

Figure 5:
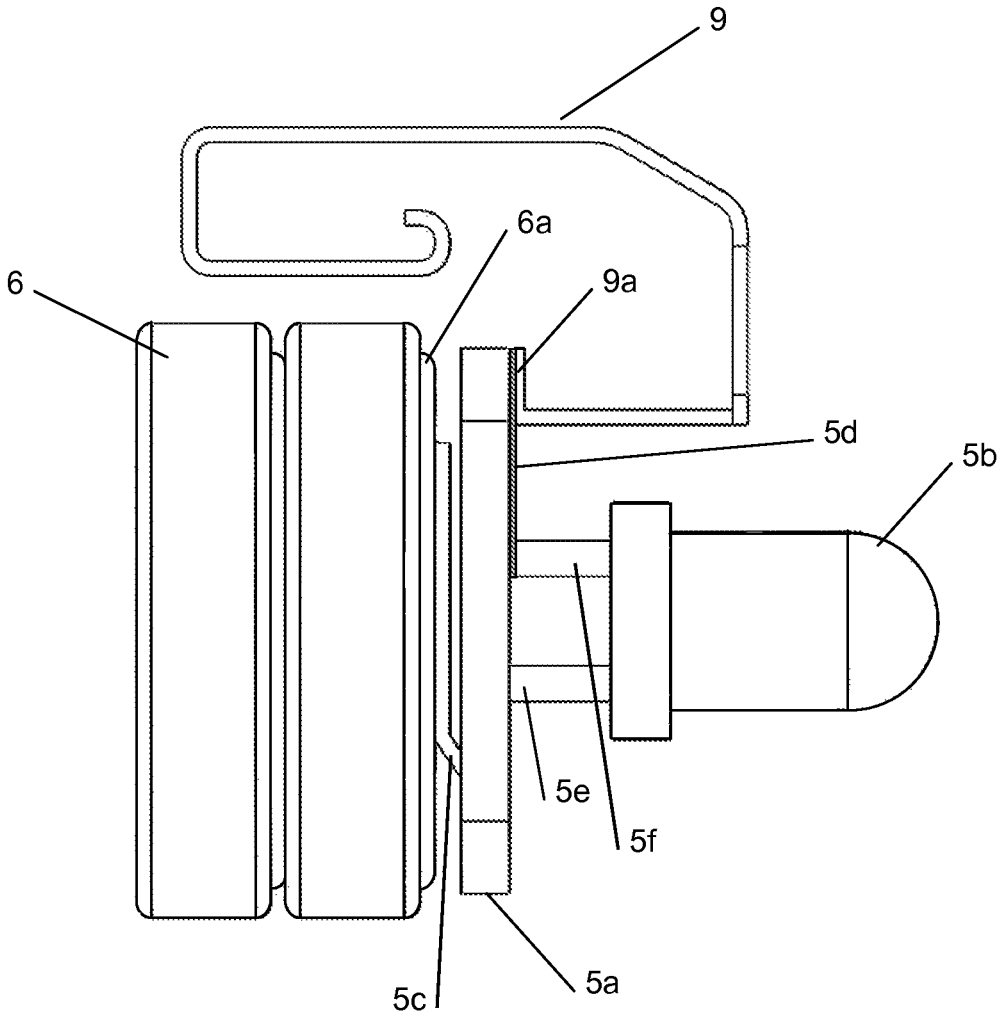
FIGS. 5 and 6 depict the electric lighting circuit of the invention in the opened and closed configurations.
Figure 6:
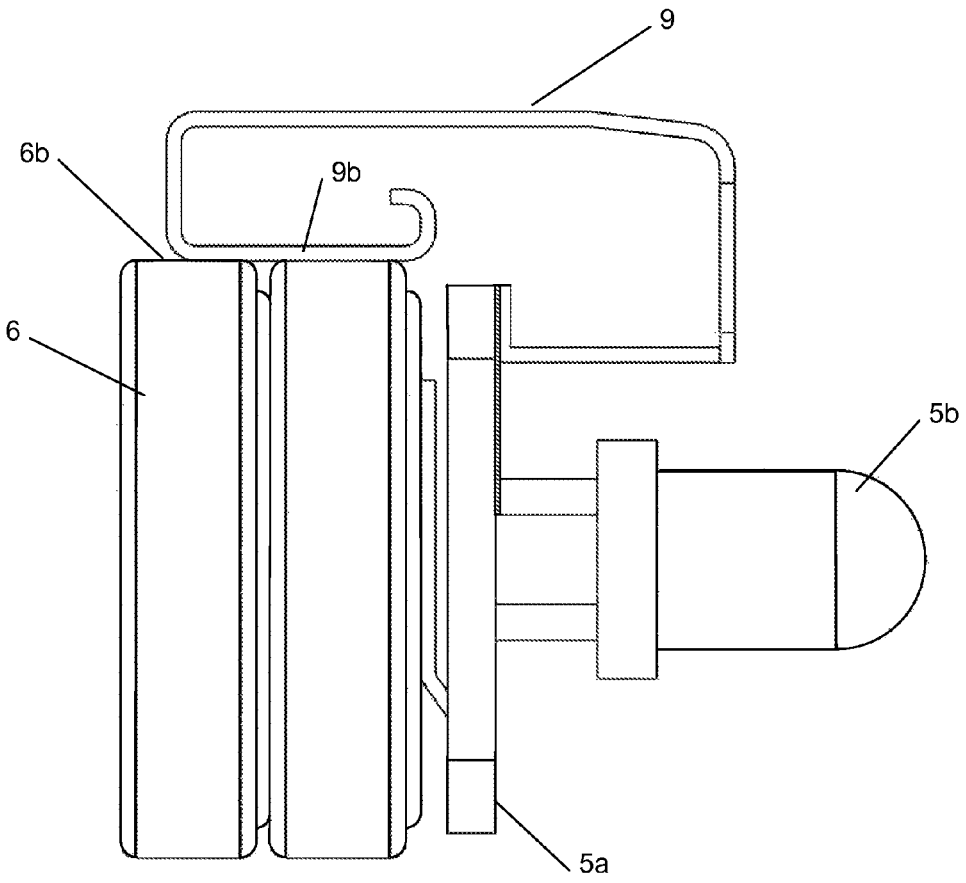

Referring to FIGS. 5 and 6, the light source assembly (5) comprises an insulated circuit board (5*a*), one or more sources of light, such as one or more LED lights (5*b*) having positive and negative electrical leads (5*e*, 5*f*), and electrical conductors (5*c*, 5*d*) affixed to either side of the board. The circuit board is housed in the back section (2*b*) of the light source housing, while the light source (5*b*) extends into the front section (2*c*), just behind the lens (4). The electrical conductor (5*c*) on the backside of the circuit board (5*a*) maintains electrical contact with a negative node (6*a*) of the power source (6), and with a corresponding negative node (5*e*) of the light source (5*b*). The electrical conductor (5*d*) on the front side of the circuit board maintains electrical contact with a positive node (5*f*) of the light source, and with a stationary portion (9*a*) of the flexible conductor (9). The stationary portion is stationary relative to the actuator (1).

The circuit board (5*a*), electrical leads (5*e*, 5*f*), electrical conductors (5*c*, 5*d*), power source (6) and light source (5*b*) comprise a lighting circuit that can be closed or opened to turn the light source on or off. In FIG. 5, the lighting circuit is opened. In FIG. 6, the lighting circuit is closed when the movable portion (9*b*) of the flexible conductor (9) is brought into contact with the positive node (6*b*) of the power source (6).

The light source assembly (5) may comprise any other circuit elements as may prove useful or desirable, as long as they do not interfere with the ability of the light source (5*b*) to illuminate the product as it moves through the actuator. Such elements may include electronic timers, voltage and/or current regulators, resistors, transistors, capacitors, motors, semi-conductors, insulators, transformers, heat sinks, auxiliary power sources, switches, logic controllers, programmable components, etc. For example, the lighting circuit may have the ability to control the operation of multiple LEDs in a predetermined succession.

The Power Source

Preferably, the power source is one or more batteries. In the drawings, the power source (6) is depicted as two batteries. Preferably, the power source can provide sufficient power to drive the light source (5*b*), at least until the product in the container (30) is used up. Many types of battery may be prove useful, depending on the amount of product in the reservoir and on the type of light source used. Examples include batteries that are commonly found in hearing aides and wrist watches, so-called "button cells" or "coin cells". In some preferred embodiments, the batteries do not contain heavy metals, for environmental and health reasons. In various embodiments, the power source is capable of providing actual (not nominal) voltages of 1 to 9 volts of electricity, over the lifetime of the container. For example, when the switch (8) is depressed, the power source in the actuator (1) provides a voltage between 1 and 3 volts, or between 1 and 6 volts, or between 1 and 9 volts, or between 3 and 6 volts, or between 3 and 9 volts, or between 6 and 9 volts of electricity. Button cells are commonly available is sizes ranging from about 5 mm to 25 mm in diameter, and 1 to 6 mm in thickness. A prime consideration is that the batteries be small enough to fit inside the actuator, without making the actuator significantly larger than what a consumer has come to expect in cosmetics or personal care packaging. Therefore, in general, smaller button cells may be preferred over larger ones. For example, button cells or coin cells 15 mm diameter or smaller are preferred over larger cells, and cells 4 mm or thinner are preferred over thicker cells. Button or coin cells 10 mm diameter or smaller are even more preferred over larger cells, and cells thinner than 3 mm are even more preferred over thicker ones.

The batteries or other power source, as well as the lighting circuit and LED, may be removable. "Removable" means that the actuator provides easy access to the batteries. Thus, damaging the actuator to get at the batteries does not meet the definition of removable. As noted above, an optional opening (2*e*) at the back of the body (2) allows access to the power source (6) and light source assembly (5). The opening (2*e*) may be closed by a removable cap (7). When this option is implemented, the batteries. LED and circuit elements can be removed easily from the actuator, either for replacement or for separate disposal as may be required by local ordinances.

On/Off Switch and Flexible Conductor

A switch that is operable by a user is provided, to allow the user to turn the light source on and off by interrupting the flow of electricity through the light source (5*b*). Various manner of switch may be provided, being well known in the art electric circuits. In the embodiment of the figures, an on/off switch is constituted by a non-conductive elastic surface (8) that sits atop the body (2) of the actuator (1). The perimeter (8*a*) of the elastic surface is designed to stretch over a circular rim (20 of the actuator body, and grip the body. The elastic surface is the top surface of the actuator body. Just below the elastic surface is a flexible electrical conductor (9). The flexible conductor (9) rests in a cut-out (2*g*) in the body of the actuator. This can be seen well in FIG. 3. The flexible conductor comprises a portion (9*a*) that is stationary relative to the actuator, and a portion (9*b*) that is movable relative to the actuator.

Figure 7:
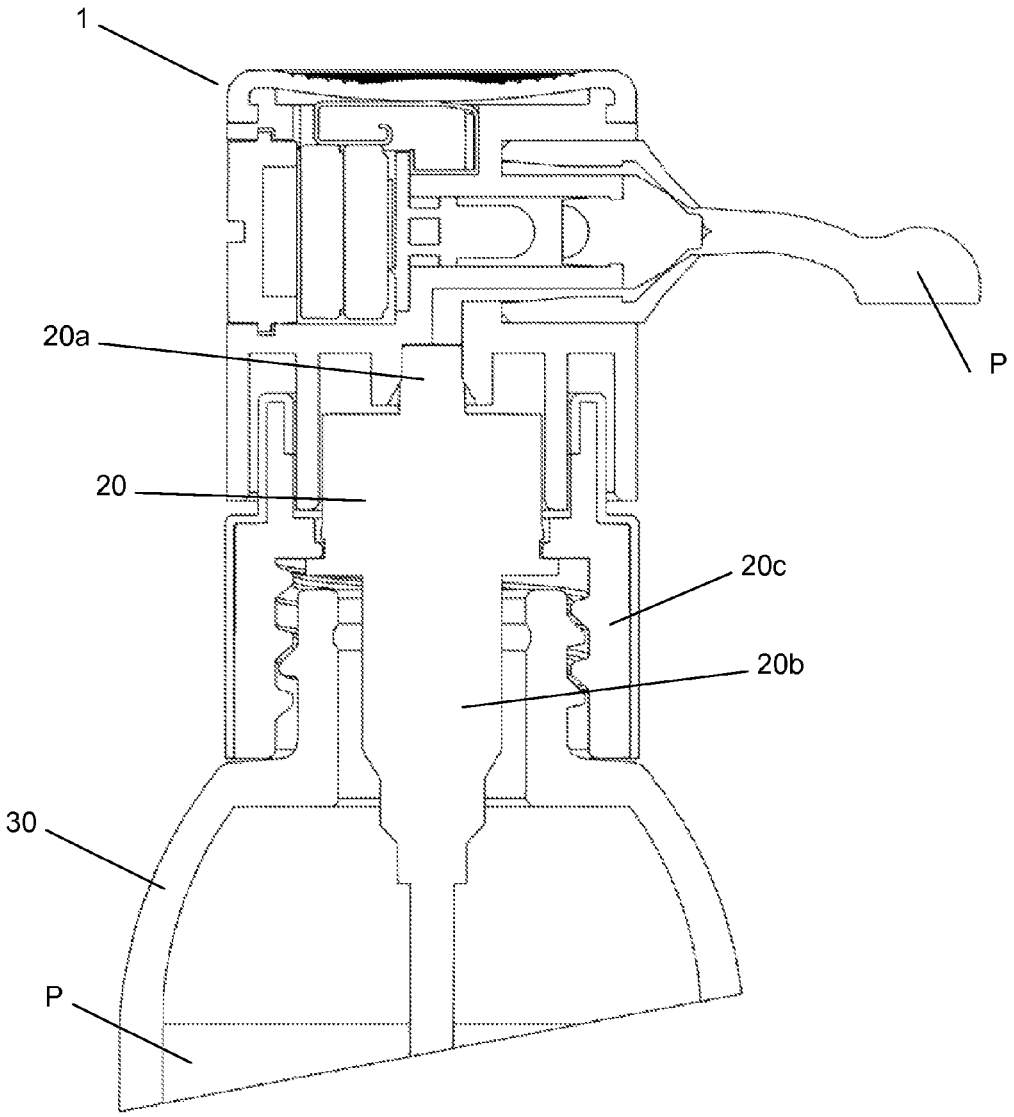
FIG. 7 depicts the actuator of the invention, in an actuated position, with product (P) moving through and out of the actuator.
Figure 8:
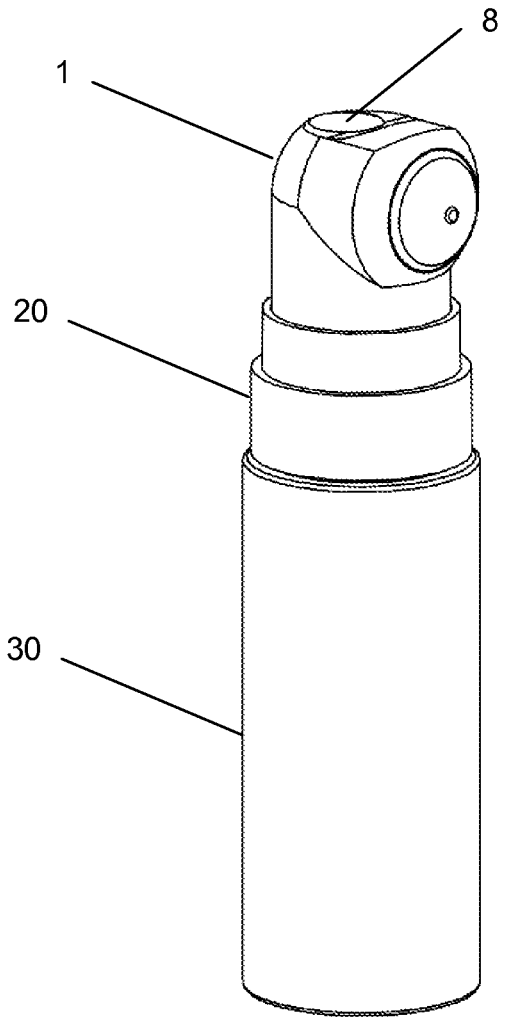
FIG. 8 is a depiction of another embodiment of an actuator according to the invention, seated on a container with pump dispenser.

In its rest position (i.e. not depressed), the elastic surface is taut, and the electric lighting circuit is opened, because the movable portion (9*b*) of the flexible conductor (9) does not have electrical contact with the positive node (6*b*) of the power source (6). When the non-conductive elastic surface is depressed by the finger of a user, the elastic surface bends the movable portion of the flexible conductor downward, until the movable portion contacts the positive node (6*b*) of the power source (see FIG. 7). At this point the circuit is closed and the light source is activated. When pressure is removed, the elastic surface and flexible conductor return to their original shape, and the circuit opens, and the light source turns off.

Furthermore, when the elastic surface (8) is depressed, the entire actuator (1) is carried downward, which forces the stem (20*a*) of the pump (20) downward, which initiates movement of product through the first and second passages (10, 11) of the actuator, toward the orifice (3*c*) of the nozzle (3). When the elastic surface is allowed to return to its rest position, the stem rises and product is drawn from the reservoir (30) into the accumulator (20*b*), to be ready for the next use. Actuators are also common on dispensing systems with valves, such as aerosol sprayers, which are also operated by depressing an actuator to dispense a product, as is well understood. Thus, a user dispenses product in exactly the same manner as with a conventional actuator, but at the same time, operates a lighting circuit that has a predetermined effect on the product being dispensed.

The Light Source

In preferred embodiments, the light source (5*b*) is capable of emitting light at a specified wavelength, or range of wavelengths that are effective to activate a precursor product (P) as it moves through the actuator (1). To initiate a predetermined change or reaction in the precursor product, the intensity of the light source must also be considered. If the light is too dim, then the cross section for reaction may be too small to affect any substantial change in the precursor product, especially considering the length of time that the precursor product is exposed to the light. In normal use, the light source is expected to be on for one second or less, as a user depresses and releases the actuator (1). Therefore, the intensity of the light at the specified wavelength should be sufficient to activate all or a substantial portion of the precursor product that is dispensed during that one second or less. The amount of light that reaches the precursor product may be adjusted by using a brighter light source.

In useful embodiments involving skin and hair care products, the light of the light source may be infrared, visible, ultraviolet or combinations of these. Infrared light may be subdivided into bands. Depending on the classification scheme, and there are several, near infrared includes about 750 nm to about 1,400 nm; short wavelength infrared includes about 1,400 nm to about 3,000 nm; middle wavelength infrared includes about 3,000 nm to about 8,000 nm; long wavelength infrared includes about 8,000 nm to about 15,000 nm, and far infrared includes about 15,000 nm to about 1,000,000 nm. Humans, at normal body temperature, radiate most strongly in the middle infrared, at a wavelength of about 10,000 nm. Visible light covers about 390 nm to about 750 nm. Ultraviolet light includes about 10 nm to about 390 nm, but most ambient UV light is UVA (390 nm-315 nm), while some UVB (315-280 nm) and UVC (280-100 nm) are also present. Each may have different implications in chemical reactions, and all useful types of light are contemplated herein. The light source (5*b*) may comprise more than one light emitting diode (LED), each emitting its own kind of light, simultaneously or in a predetermined succession controlled by the electric lighting circuit embodied on the circuit board (5*a*).

The Light Sensitive Product and Container

As the actuator (1) is depressed, flowable product (P) is drawn from container/reservoir (30) by the action of pump (20). Eventually, the product passes through the actuator, where it is illuminated by the light source (5*b*). The flowable product in the container may be an end use product, or it may be a precursor to an end use product. For example, the flowable product in the container may be a cosmetic product, a topically applied skin treatment product, a hair product, a nail product, a dental product, an eye product, or an ingestible product. Alternatively, the flowable product in the container may not be intended for cosmetic or personal care treatment or ingestion. For example, the flowable product may be an adhesive.

In preferred embodiments, the light from light source (5*b*) initiates one or more physical and/or chemical changes in all or a portion of a precursor product (P) as the product passes through the actuator (1). That is, the precursor product is light sensitive. For example, the light may initiate a reaction that alters the precursor product to have a property that it did not have before the reaction. Or, for example, the light may initiate a reaction that alters the precursor product to have a property to more or less of a degree, than it had before the reaction. The change in the precursor product may occur at the molecular or atomic levels. The precursor product may undergo a chemical reaction. For example, the reaction may be: endothermic, exothermic, pH neutralizing, an acid-base reaction, a curing reaction, softening, vaporizing, polymerizing, oxidizing, reducing, an ion forming reaction, organic, inorganic, or a photodecomposition reaction. In particularly useful embodiments of the present invention, the reaction may be oxidizing, reducing, endothermic, exothermic, or combinations thereof, to result in an end use product intended for application to skin or hair.

As noted, the light supplied by the light source (5*b*) may initiate one or more physical and/or chemical changes in all or a portion of a precursor product (P) as it moves through the actuator. The word "initiate" includes any situation in which a rate at which a precursor product changes on the molecular level is altered by the light of the light source. This may mean that a change is already occurring in the precursor product, before the light is supplied, but the rate at which the change is occurring is altered (either increased or decreased) by the light. Or, it may mean that a particular change is not occurring at all, until the light is supplied. In some cases, "initiate" will mean that the light supplied by the light source is sufficient to overcome some threshold energy for a reaction to proceed. In other cases, "initiate" will mean that the light supplied by the light source increases some threshold energy, so that some reaction is less likely to occur. In some embodiments, "initiate" may mean that the light supplied by the light source causes a change in only one portion of the precursor product (P), but thereafter, the reaction spreads to other portions of the precursor product in the actuator, even in the absence of the light. In other embodiments, a portion of precursor product can only undergo a change in the presence of the light.

In those embodiments of the actuator (1) that include more than one kind of light, a precursor product (P) may undergo one or more different reactions associated with each kind of light. In some embodiments, the different kinds of light may be supplied simultaneously. In other embodiments, the different kinds of light may be supplied in a predetermined succession, thus controlling the order of the changes that the precursor product undergoes.

In other useful embodiments, the light supplied by the light source (5*b*) initiates one or more changes to components that are not, strictly speaking, part of the flowable product (P). For example, the light may kill microbes in all or a portion of the product that is located in the actuator (1). In one embodiment, the light source is strong in the 250-270 nm range. In another embodiment, the light source is strong in the 355-375 nm range. Microbes may include, for example, bacteria, viruses, fungi, archaea, protists, green algae, plankton and planarian. Alternatively, the light may promote the growth of one or more kinds of microbes in the product, if that is desired.

Particularly interesting are photoinitiators. A photoinitiator is a chemical compound that decomposes into free radicals when exposed to light. Photoinitiators may be useful in a precursor product when used with an actuator according to the present invention. Peroxides (i.e. benzoyl peroxide), azo-compounds, benzoin, and nitrogen dioxide are examples of photoinitiators that may be useful in preparing precursor products that are useful with an actuator according to the present invention. Azo compounds are compounds bearing the functional group R—N═N—R', in which R and R' can be either aryl or alkyl. It may be useful to use a combination of different light sensitive molecules in a precursor product, such as, a combination of different photoinitiators. Also interesting are reactions that split a carrier molecule in the precursor product (P), so that the carrier molecules release a second molecule that has some cosmetic or personal care benefit, especially a benefit for the skin or hair.

In all cases, a person of ordinary skill in the art will be readily able to determine by observation and/or routine experimentation, whether the light source (5*b*) is having a useful and/or intended effect on the product. Adjustments to the intensity and wavelength of light can be made until the desired result is achieved.

What is claimed is:

1. An actuator that is able to interact with a stem or valve of a product dispenser, the actuator comprising:

a body that supports a nozzle, the body is able to connect to the stem or valve of the product dispenser;

a product passageway through the body that leads from stem or valve of the product dispenser to a product exit orifice of the nozzle, when the actuator is connected to the stem or valve; and a lighting circuit housed in the body that is able to irradiate product located in the product passageway.

2. The actuator of claim 1 wherein the lighting circuit comprises a circuit board, electrical leads, electrical conductors, a power source, a light source and a switch.

3. The actuator of claim 2 comprising a flexible conductor that has a movable portion that may be brought into contact with a node of the power source or released from contact with a node of the power source.

4. The actuator of claim 3 wherein a top surface of the actuator comprises a non-conductive elastic surface such that, when the elastic surface is depressed, the product dispenser is actuated, and the elastic surface bends the movable portion of the flexible conductor downward, until the movable portion contacts a node of the power source, thus closing the lighting circuit.

5. The actuator of claim 4 wherein the light source is capable of emitting light at a specified wavelength, or range of wavelengths that are effective to activate a precursor product as it moves through the actuator.

6. The actuator of claim 5 wherein the light source is one or more LEDs that emit infrared light, visible light, ultraviolet light or combinations of these.

7. The actuator of claim 4 wherein the power source is one or more batteries housed in the body of the actuator, each battery being 15 mm in diameter or smaller.

8. The actuator of claim 4 wherein the body further comprises:

an opening that allows access to the power source and light source, and a removable cap that is able to close the opening.

9. The actuator of claim 1 that further comprises a lens, wherein the lens is supported by the body and protrudes into the nozzle, such that:

product in the product passageway must move over the lens; and light from the lighting circuit must pass through the lens before irradiating the product located in the product passageway.

10. The actuator of claim 9 wherein a proximal portion of the lens comprises a concave back side, and a distal portion of the lens comprises a convex or conical front side.

11. The actuator of claim 10 wherein a distal end of the nozzle is flexible, and fits very closely over the distal portion of the lens, so that:

when product is not flowing through the actuator, there is contact between the nozzle and the lens, effectively obstructing the product passageway; and when product is flowing through the actuator, the distal end of the nozzle flexes slightly to open up the product passageway, and allow product to flow to and out of the exit orifice.

12. A consumer package comprising:

a reservoir of product;

a product dispenser that is attached to the reservoir and able to draw product from the reservoir; and an actuator according to claim 2, seated on the product dispenser.

13. The package of claim 12 wherein the product dispenser is a lotion pump dispenser, a liquid spray dispenser, an aerosol valve dispenser or a reservoir-under-pressure type dispenser.

14. The package of claim 13 wherein the light from light source initiates one or more physical and/or chemical changes in all or a portion of the product as the product passes through the actuator.

15. The package of claim 14 wherein the chemical changes occur as a result of one or more chemical reactions selected from: endothermic, exothermic, pH neutralizing, an acid-base reaction, a curing reaction, softening, vaporizing, polymerizing, oxidizing, reducing, an ion forming reaction, organic, inorganic, and a photo-initiated reaction.

* * * * *